US008137761B2

(12) United States Patent
Gerke et al.

(10) Patent No.: US 8,137,761 B2
(45) Date of Patent: Mar. 20, 2012

(54) METHOD OF COATING AND INDUCTION HEATING A COMPONENT

(75) Inventors: Daniel Herbert Gerke, Chillicothe, IL (US); Karen Renee Raab, Peoria, IL (US); Beth Ann Sebright, Chillicothe, IL (US); Candice Ann Lundy, Peoria, IL (US); Michael Ray Loomis, Greenwood, IN (US)

(73) Assignee: Caterpillar Inc., Peoria, IL (US)

( * ) Notice: Subject to any disclaimer, the term of this patent is extended or adjusted under 35 U.S.C. 154(b) by 656 days.

(21) Appl. No.: 12/230,320

(22) Filed: Aug. 27, 2008

(65) Prior Publication Data

US 2009/0311545 A1 Dec. 17, 2009

Related U.S. Application Data

(63) Continuation-in-part of application No. 12/213,082, filed on Jun. 13, 2008.

(51) Int. Cl.

| | |
|---|---|
| ***B05D 3/02*** | (2006.01) |
| ***B05D 3/04*** | (2006.01) |
| ***B05D 3/06*** | (2006.01) |
| ***H05B 6/02*** | (2006.01) |
| ***H05B 6/36*** | (2006.01) |
| ***H05B 6/40*** | (2006.01) |

(52) U.S. Cl. ..... 427/543; 427/591; 427/226; 427/376.5

(58) Field of Classification Search ..... None
See application file for complete search history.

(56) References Cited

U.S. PATENT DOCUMENTS

| | | | | |
|---|---|---|---|---|
| 2,866,728 | A | 12/1958 | Warinner | |
| 2,901,385 | A | 8/1959 | Curtin | |
| 3,033,705 | A | 5/1962 | Hanink et al. | |
| 3,383,233 | A | 5/1968 | Curcio | |
| 3,634,145 | A | 1/1972 | Homan | |
| 3,652,463 | A | 3/1972 | Riddel | |
| 3,761,293 | A | 9/1973 | Carini et al. | |
| 3,868,280 | A | 2/1975 | Yamamoto et al. | |
| 3,925,570 | A | 12/1975 | Reinke et al. | |
| 3,948,684 | A * | 4/1976 | Armstrong | 427/115 |
| 3,999,040 | A | 12/1976 | Ellis | |

(Continued)

FOREIGN PATENT DOCUMENTS

WO WO 2005/080515 A1 * 9/2005

OTHER PUBLICATIONS

Fuel Cell Handbook, Fifth Edition, Oct. 2000, Business/Technology Books, Orinda, Ca. p. 1-1.

*Primary Examiner* — Marianne L Padgett
(74) *Attorney, Agent, or Firm* — Finnegan, Henderson, Farabow, Garrett & Dunner LLP

(57) ABSTRACT

A method of coating a component is disclosed. The method includes applying a coating composition to a surface of the component. The method also includes providing an induction coil having a coil configuration corresponding to the surface. The method further includes relatively positioning the surface and the induction coil with a gap sufficient to enable induction heating of the surface by the induction coil. Furthermore, the method includes heating the component with the induction coil sufficient to produce a coating having an empirical formula $Fe_xMn_yO_z$, where x varies from about 0 to about 2, y varies from about 1 to about 4, and z varies from about 2 to about 8.

18 Claims, 3 Drawing Sheets

U.S. PATENT DOCUMENTS 4,064,074 A 12/1977 Ellis
4,072,586 A * 2/1978 De Nora et al. ..... 205/576
4,256,545 A * 3/1981 Deborski ..... 204/290.01
4,673,444 A 6/1987 Saito et al.
4,681,641 A 7/1987 Zurilla et al.
4,726,208 A * 2/1988 Saunders ..... 72/47
5,015,341 A * 5/1991 Guzzetta et al. ..... 148/518
5,130,165 A * 7/1992 Shao et al. ..... 427/543
5,238,506 A 8/1993 Cape et al.
5,290,589 A * 3/1994 Clough et al. ..... 427/126.3
5,534,313 A 7/1996 Kung et al.
5,604,040 A 2/1997 Sugama
5,674,644 A * 10/1997 Nazri ..... 429/224
5,783,622 A * 7/1998 Sabata et al. ..... 524/444
5,790,368 A * 8/1998 Naito et al. ..... 361/523
5,904,786 A 5/1999 Wendel et al.
5,942,291 A 8/1999 Bywalez
5,955,052 A * 9/1999 Padhi et al. ..... 423/599
6,001,494 A 12/1999 Kuchinski et al.
6,074,464 A 6/2000 Eddinger et al.
6,107,613 A 8/2000 Welch et al.
6,153,270 A 11/2000 Russmann et al.
6,322,906 B1 11/2001 Nakakoji et al.
6,342,107 B1 1/2002 Miyamoto et al.
6,368,426 B1 4/2002 Sienkowski et al.
6,461,449 B1 10/2002 Matsubara et al.
6,497,772 B1 12/2002 Meckel et al.
6,551,417 B1 4/2003 Rodzewich et al.
6,620,263 B1 9/2003 Sienkowski
6,794,086 B2 9/2004 Dai et al.
6,835,460 B2 12/2004 Cuyler et al.
6,926,997 B2 8/2005 Guidotti et al.
7,183,526 B2 2/2007 Yoshino et al.
7,491,469 B2 2/2009 Guidotti et al.
2002/0122942 A1 9/2002 Aichele et al.
2003/0056520 A1* 3/2003 Campbell et al. ..... 60/777
2003/0103875 A1 6/2003 Campbell et al.
2003/0134191 A1* 7/2003 Buckle et al. ..... 429/176
2004/0031692 A1 2/2004 Hardee
2005/0257848 A1* 11/2005 Funatsu et al. ..... 138/146
2006/0199063 A1 9/2006 Miura et al.
2007/0166466 A1* 7/2007 Kashiwada et al. ..... 427/372.2
2008/0318035 A1 12/2008 Sebright
2009/0209415 A1 8/2009 Kayama et al.

* cited by examiner

METHOD OF COATING AND INDUCTION HEATING A COMPONENT

This application is a continuation-in-part of U.S. patent application Ser. No. 12/213,082, filed Jun. 13, 2008, which is herein incorporated by reference.

TECHNICAL FIELD

The present disclosure relates generally to coating and heating a component, and more particularly, to a method of coating and induction heating a component.

BACKGROUND

Components are sometimes coated on their surfaces with a material to locally modify the properties of the components. The surface coating of a component with a corrosion resistant material may increase the corrosion resistance of the component without sacrificing the beneficial properties of the material from which the component is made. An especially difficult environment to provide protection for a metal substrate is one which combines a high temperature corrosive ambient with wear, as occurs in turbocharger housings and exhaust components of internal combustion engine systems. A type of surface coating used in industry to increase corrosion and wear resistance of metal components is conversion coating. Conversion coating is surface coating where a part of the surface of the metal component is converted into the coating with a chemical or electro-chemical process.

As disclosed in U.S. Pat. No. 5,783,622 (the '622 patent), issued to Sabata et al. on Jul. 21, 1998, a chromate solution may be used as the corrosion resistant material to be applied to a component made of steel alloy. The chromate solution may be applied to the surface of the metal component by applying a layer of a liquid coating composition and then drying the applied solution. The drying may be performed by means of a heating method, including using an induction oven, where the maximum temperature attained may be less than 300° C.

Although the conversion coating of the '622 patent may be suitable for coating of a steel alloy surface, it may not be suitable for coating of a cast iron surface, for example. In addition, the conversion coating of the '622 patent may not be suitable for application where the maximum temperature of the heating method may be more than 300° C.

The devices and methods of the present disclosure are directed towards improvements in the existing technology.

SUMMARY

In one aspect, a method of coating a component is disclosed. The method may include applying a coating composition to a surface of the component. The method may also include providing an induction coil having a coil configuration corresponding to the surface. The method may further include relatively positioning the surface and the induction coil with a gap sufficient to enable induction heating of the surface by the induction coil. Furthermore, the method may include heating the component with the induction coil sufficient to produce a coating having an empirical formula $Fe_xMn_yO_z$, where x varies from about 0 to about 2, y varies from about 1 to about 4, and z varies from about 2 to about 8.

In another aspect, a component surface of ferrous metal is disclosed. The component may be coated by a process of applying a coating composition to a surface of the component. The process may also include providing an induction coil having a coil configuration corresponding to the surface. The process may further include relatively positioning the surface and the induction coil with a gap sufficient to enable induction heating of the surface by the induction coil. Furthermore, the process may include heating the component with the induction coil sufficient to produce a coating having an empirical formula $Fe_xMn_yO_z$, where x varies from about 0 to about 2, y varies from about 1 to about 4, and z varies from about 2 to about 8.

In yet another aspect, an engine system is disclosed. The engine system may include a power source, an air induction system, and an exhaust system. The engine system may also include a component of at least one of the power source, the air induction system, and the exhaust system, the component including portions having different thicknesses, and a surface coated by a process of applying a coating composition to a surface of the component. The process may also include providing an induction coil having a coil configuration corresponding to the surface. The process may further include relatively positioning the surface and the induction coil with gaps corresponding to the portions having different thicknesses and sufficient to enable induction heating of the surface by the induction coil. Furthermore, the process may include heating the component with the induction coil sufficient to produce a coating having an empirical formula $Fe_xMn_yO_z$, where x varies from about 0 to about 2, y varies from about 1 to about 4, and z varies from about 2 to about 8.

DETAILED DESCRIPTION

Figure 1:
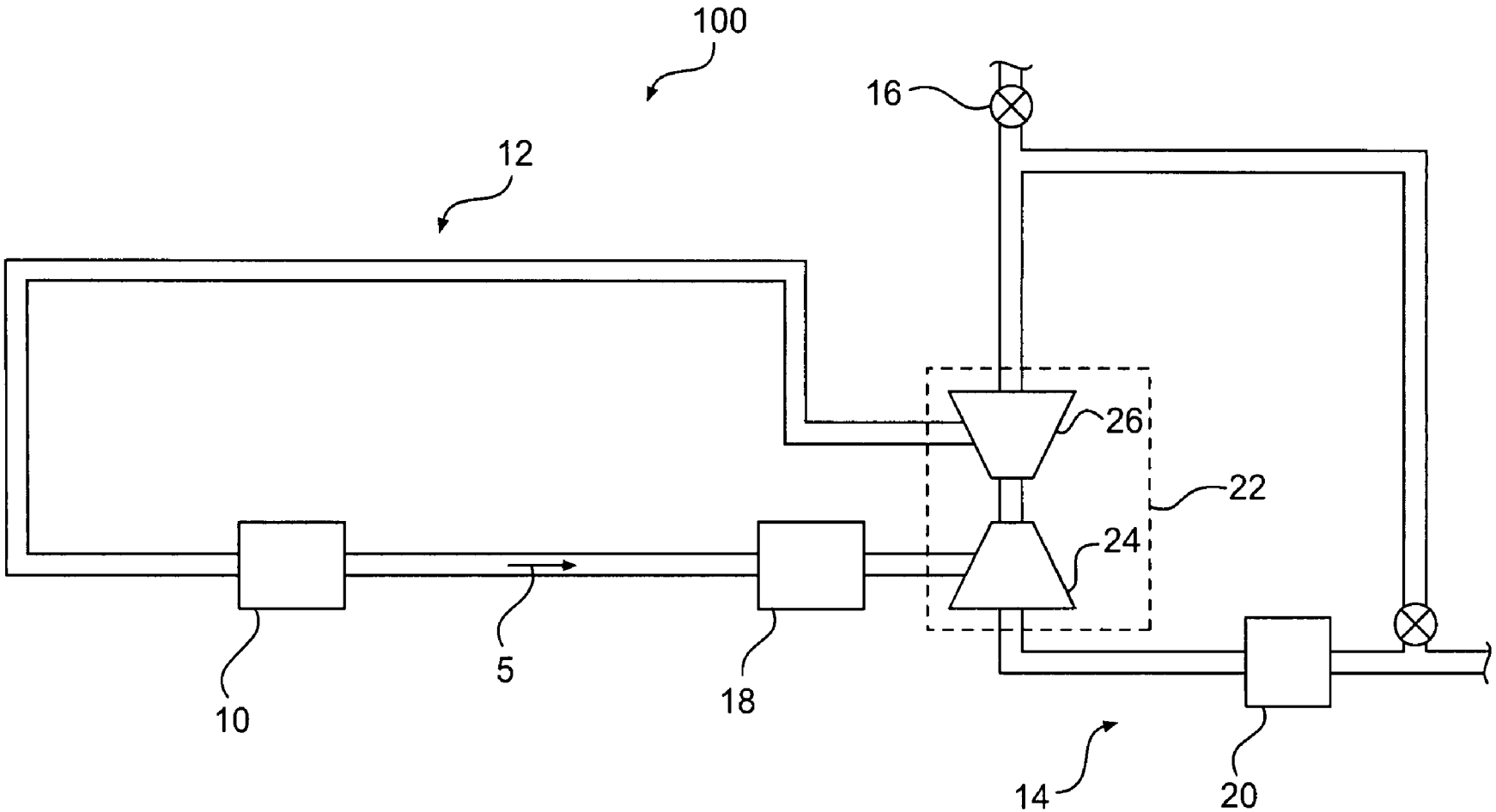
FIG. 1 is an illustration of an engine system according to a disclosed embodiment.

FIG. 1 illustrates an engine system 100. Engine system 100 may include a power source 10, and an air induction system 12, and an exhaust system 14. Power source 10 may be an engine system such as, for example, a diesel engine system, a gasoline engine system, a natural gas engine system, or any other engine system known in the art. Power source 10 may produce exhaust 5. Exhaust 5 may exit to the atmosphere through exhaust system 14.

Air induction system 12 may be configured to introduce compressed air into engine system 100. Air induction system 12 may include components configured to provide compressed air into power source 10. These components may include any components known in the art such as, valve 16, air coolers, additional valves, air cleaners, control system, etc. Exhaust system 14 may be configured to direct exhaust 5 out of power source 10. Exhaust 5 may be hot and may contain certain particulate matter that may be removed before exhaust 5 may exit engine system 100. Exhaust system 14 may include components that may be configured to separate the particulate matter from exhaust 5. These components may include a first particulate filter 18 and a second particulate filter 20. Exhaust system 14 may also include components that are configured to extract power from exhaust 5, such as a turbocharger 22.

Turbocharger 22 may include a turbine 24 connected to a compressor 26. Turbine 24 may receive exhaust 5. In some embodiments, a portion of exhaust 5 may be mixed with ambient air being compressed in compressor 26. The particulate matter contained in exhaust 5 may include ash of metallic salts ("ash") produced due to the combustion of impurities, such as sulphur, vanadium, sodium, potassium, and other metals, present in the fuel. These and other particulate matter may be deposited on the metallic surfaces of turbine 24 when exhaust 5 is exiting engine system 100 and cause wear. Some of these deposits may also adhere to the surfaces of turbine 24. Adhering particulate matter may be corrosive and may corrode the metallic surfaces of turbine 24 over time. The corrosivity of the particulate matter may increase with the temperature of exhaust 5 and the composition, i.e., the chemical makeup, of the particulate matter.

Figure 2:
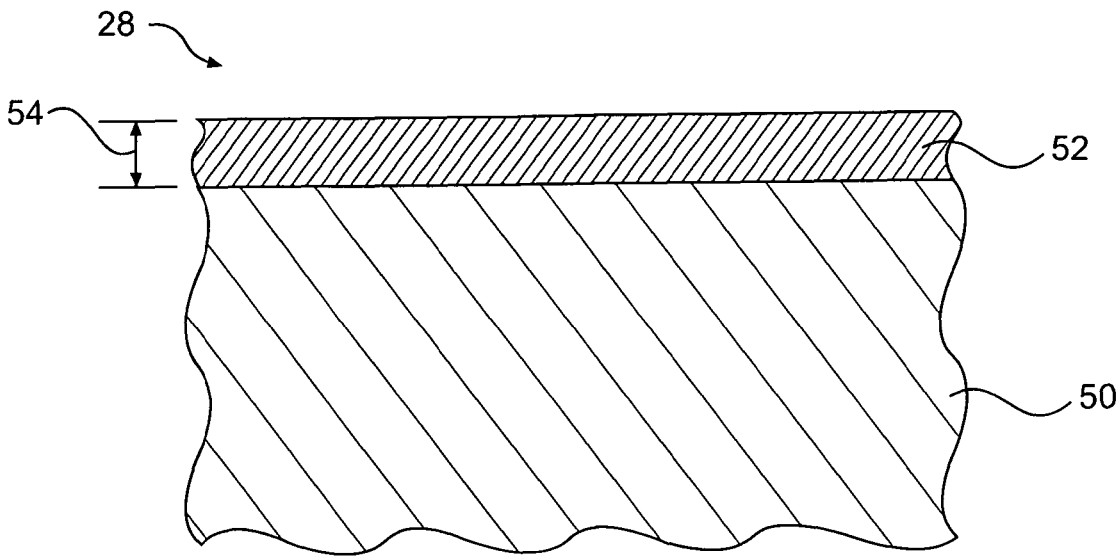
FIG. 2 is an illustration of an embodiment of a coating on a component of the engine system of FIG. 1.

FIG. 2 illustrates a surface 28 of turbocharger 22 (referring to FIG. 1). Surface 28 may include a substrate 50 and a coating 52. Substrate 50 may be made of any metallic material. In some embodiments, substrate 50 may be a ferrous material, such as a steel alloy or cast iron. Substrate 50 may be generally planar in shape. However, it is contemplated that substrate 50 may include curved surfaces and generally be of any geometric shape. Substrate 50 may be a newly fabricated component, or may be a remanufactured component, i.e., a component that has been previously used in an engine system. Similarly, coating 52 may be a newly applied coating, or may be a re-coating, i.e., reapplication of coating 52 to a surface where an original coating on the surface may be worn. Coating 52 may substantially conform to the shape of substrate 50. However, it is contemplated that coating 52 may not cover some discontinuities on the surface of substrate 50, including crevices, points, pores, cracks, sharp edges, and internal surfaces, etc.

Substrate 50 may be prepared for coating before applying coating 52 to the surface of substrate 50. Substrate 50 may be prepared by any process configured to clean and prepare the surface of substrate 50 before applying coating 52. The surface of substrate 50 may be cleaned of any rust, debris, or other contaminants ("contaminants"). For remanufactured components, these contaminants may also include remnants of the previous coating. In these embodiments, all or part of the worn coating may be removed from substrate 50. It is contemplated that mechanical cleaning, chemical-assisted cleaning, chemical stripping, and/or abrasive blasting may be used to prepare the surface of substrate 50 before applying coating 52.

After the contaminants are removed from the surface of substrate 50, in some embodiments, the surface of substrate 50 may be rinsed and dried. Coating 52 may then be applied to the surface of substrate 50. A liquid delivery device (not shown) may be used to deliver a coating solution to the surface of substrate 50. The liquid delivery device may be any suitable device configured to deliver the coating solution to the surface of substrate 50. For example, the liquid delivery device may include one or more of a mister, a sprayer, a dispenser, etc. Alternatively, surface 28 may be dipped into the coating solution. The coating solution may include an aqueous solution of a permanganate and an acidic metal phosphate solution in water. Permanganates are salts of permanganic acid, such as potassium permanganate ($KMnO_4$) and sodium permanganate ($NaMnO_4$). The permanganate may contain the permanganate ion ($MnO_4^-$). Because manganese (Mn) is in the +7 oxidation state, the permanganate ion may be a strong oxidizer. The acidic metal phosphate solution may be formed by the dissolution of a primary metal salt in phosphoric acid. The metal salt dissolved in the phosphoric acid may include salts such as zinc oxide, manganese oxide, aluminum oxide, etc. Exemplary phosphate solutions may include one or more of sodium hemiphosphate; sodium dihydrogen phosphate monohydrate; sodium dihydrogen phosphate dihydrate; sodium dihydrogen phosphate compound with disodium hydrogen phosphate (MSP-DSP); disodium hydrogen phosphate dihydrate; disodium hydrogen phosphate heptahydrate; disodium hydrogen phosphate octahydrate; disodium hydrogen phosphate dodecahydrate; trisodium phosphate hemihydrate; trisodium phosphate hexahydrate; trisodium phosphate octahydrate; trisodium phosphate dodecahydrate; monopotassium phosphate; dipotassium phosphate; dipotassium hydrogen phosphate trihydrate; dipotassium hydrogen phosphate hexahydrate; tripotassium phosphate; tripotassium phosphate trihydrate; tripotassium phosphate heptahydrate; tripotassium phosphate nonahydrate; calcium hydrogen phosphate; calcium hydrogen phosphate hemihydrate; calcium hydrogen phosphate dihydrate; aluminum dihydrogen phosphate; aluminum dihydrogen tripolyphosphate; aluminum phosphate dihydrate; monoaluminum phosphate sesquihydrate; dialuminum phosphate trihydrate; poly(aluminum metaphosphate); monoiron (III) phosphate; trimagnesium phosphate octahydrate; aluminum hemiphosphate; etc.

For an embodiment of the coating solution having potassium permanganate and aluminum dihydrogen phosphate in water, the concentration of the constituents may be about 4 grams (gms) to about 12 gms of potassium permanganate to about 1 milliliter (ml) to about 5 mls of aluminum dihydrogen phosphate ($AlH_2PO_4$) in about 150 mls of water. Ions such as $MnO_4^-$, $K^+$, $Al_x^+$, $H^+$, $PO_4^{3-}$ may exist in such a coating solution. When the coating solution is applied to surface 28, the coating solution may form a thin layer on surface 28. Redox reactions (reduction/oxidation) may also begin to take place on surface 28.

Coating 52 may have a thickness 54. Thickness 54 of coating 52 over the surface of substrate 50 may be substantially uniform. Alternatively, it is contemplated that thickness 54 of coating 52 may vary over the surface of substrate 50. Coating 52 may be substantially made of one or more compounds having an empirical formula $Fe_xMn_yO_z$, where x may vary from about 0 to about 2, y may vary from about 1 to about 4, and z may vary from about 2 to about 8. For example, coating 52 may be made of compounds having the empirical formula $FeMnO_4$, $FeMnO_2$, $MnO_2$, $Fe_2MnO_4$, etc. An empirical formula is a formula that indicates the relative proportions of the atoms in a molecule rather than the actual number of atoms of the elements. For instance, a chemical formula $Fe_2Mn_4O_2$ for a compound may indicate that a molecule of the compound may have 2 atoms of Fe, 4 atoms of Mn, and 2 atoms of O. The same compound may also be expressed by an empirical formula of $Fe_1Mn_2O_1$ (that is, $Fe_{2/2}Mn_{4/2}O_{2/2}$). In some embodiments, coating 52 may be substantially made up of the same compound. In other embodiments, coating 52 may include multiple compounds, each compound having the empirical formula $Fe_xMn_yO_z$. For example, a portion of coating 52 may be substantially made of $FeMnO_4$ while another portion of coating 52 may be made of $MnO_4$.

Figure 3:
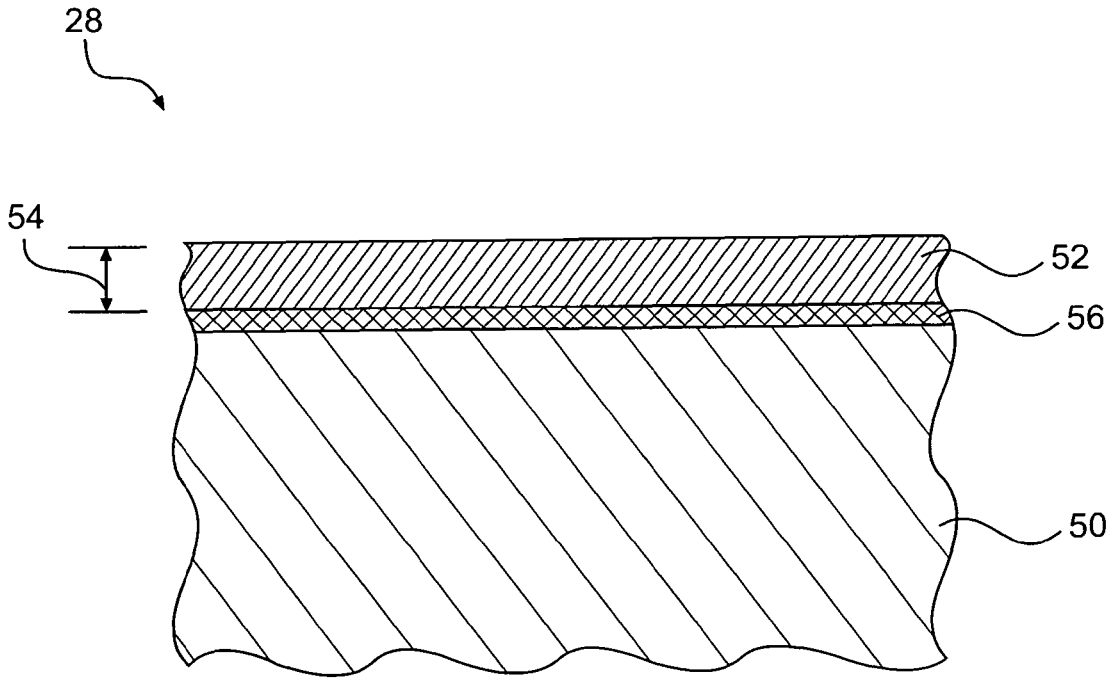
FIG. 3 is an illustration of another embodiment of a coating on a component of the engine system of FIG. 1.

As shown in FIG. 3, surface 28 may include a second coating, such as an adhesion layer 56. It is contemplated that the second coating may be a reapplication of coating 52. Adhesion layer 56 may be disposed between substrate 50 and coating 52. Adhesion layer 56 may be made of any material that may improve the adhesion and/or surface wettability of coating 52 on substrate 50. For example, adhesion layer 56 may be remnants of a material used to improve the surface wettability or adhesion of coating 52 on substrate 50.

After coating 52 is applied to substrate 50, surface 28 may be heated. Any process known in the art may be used to heat surface 28. During heating, surface 28 may be soaked at a high temperature for about 1 to about 10 minutes. At this temperature, the redox reactions on surface 28 may speed up. Depending upon the concentrations of the individual components in the coating solution and the reaction conditions, the coating 52 formed on surface 28 may include a mixed oxide of iron and manganese. In some embodiments, a thin adhesion layer 56 may also be formed between substrate 50 and coating 52. The adhesion layer 56 may include a phosphate compound. The phosphate compound may be formed by a reaction of the $PO_4^{3-}$ ions of the coating solution, for example.

Surface 28 may be heated at an appropriate temperature where coating 52 may adhere to substrate 50 of surface 28. For example, surface 28 may be heated at a temperature of approximately 600° C. In some embodiments, substrate 50 may first be heated to a temperature of approximately 100° C. for a period of time to ensure that any water in the coating solution may be evaporated. The heating temperature and soaking time may depend upon the coating solution used and the size of surface 28. It is contemplated that depending upon the coating solution used, phase transformation (e.g., where $MnO_4$ transforms to the more stable $MnO_2$ oxidation state) may occur at about 600° C. However, in some embodiments, the heating of surface 28 may be performed at other temperatures, even below 600° C.

Figure 4:
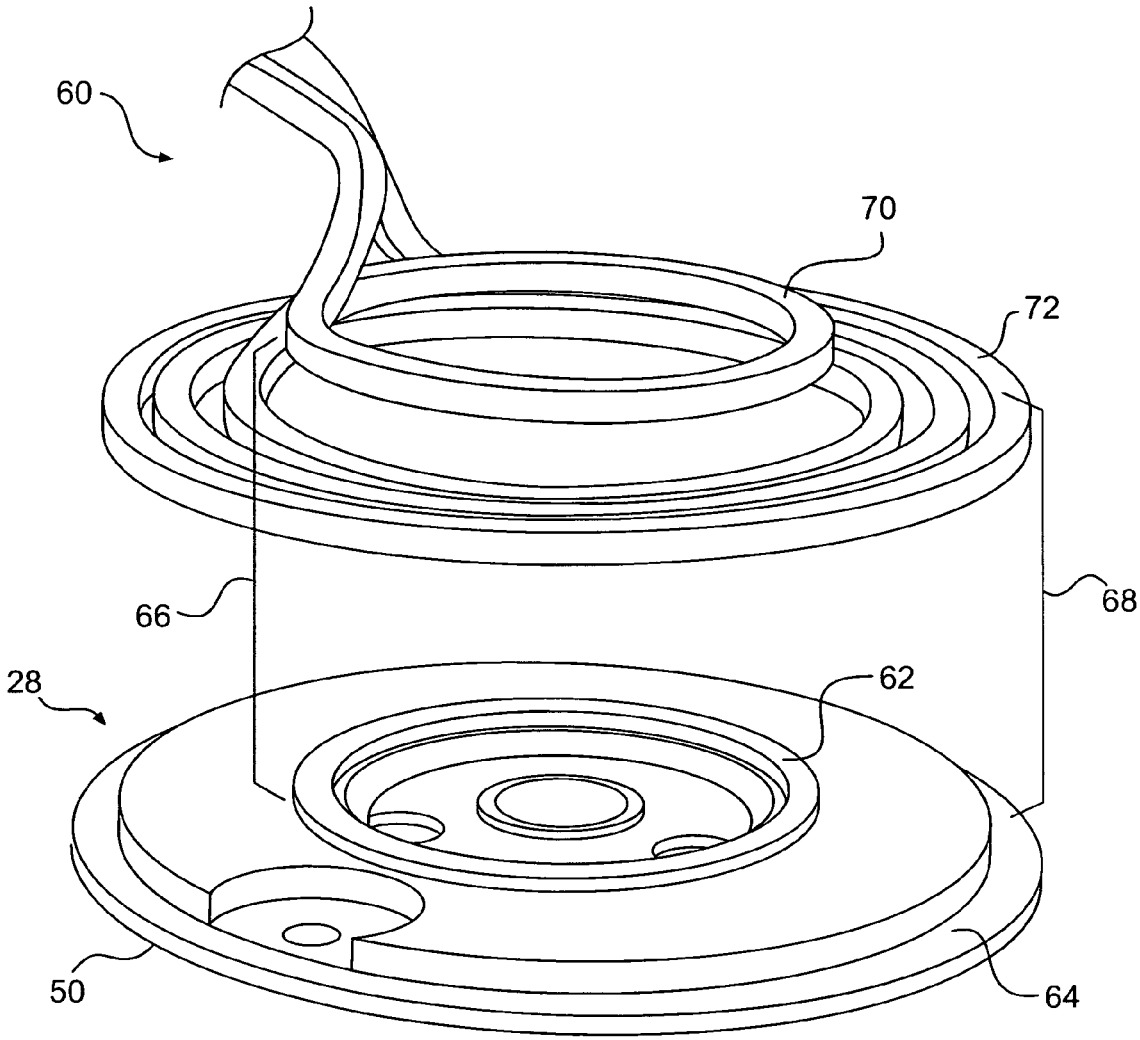
FIG. 4 is an illustration of an embodiment of an application of the coating of FIG. 2 on a component of the engine system of FIG. 1.

Surface 28 may be heated using induction coil 60 as shown in FIG. 4, for example. Induction coil 60 may have a coil configuration corresponding to the configuration of surface 28. Surface 28 may be located adjacent induction coil 60 such that gaps may exist between induction coil 60 and surface 28. In some embodiments, surface 28 may include portions of different thicknesses. For example, surface 28 may include an upper portion 62 and a lower portion 64. Gap 66 may exist between upper portion 62 and a first portion 70 of induction coil 60. Similarly, gap 68 may exist between lower portion 64 and a second portion 72 of induction coil 60. Gap 66 may be greater than gap 68. Gaps 66 and 68 may be sufficient to enable induction heating of surface 28 by induction coil 60. While surface 28 is described as having two portions of different thicknesses, it is contemplated that surface 28 may include more than two portions of different thicknesses and different gaps may exist between the portions of different thicknesses and the corresponding portions of induction coil 60. For example, lower portion 64 may be of greater thickness than upper portion 62, as illustrated in FIG. 4. Alternatively, upper portion 62 may be of greater thickness than lower portion 64.

Induction coil 60 may be made of electrically conductive material, such as metal. Induction coil 60 may also be made of a flexible material, for example. Currents may be introduced in induction coil 60, which may generate an electromagnetic field around induction coil 60. Eddy currents may be generated within substrate 50, and resulting resistance may lead to Joule heating of substrate 50, e.g., by the process in which the passage of an electric current through an electrically conductive material releases heat. While induction coil 60 is shown to be generally circular in shape in FIG. 4, it is contemplated that the shape (e.g., geometrical and/or dimensional) of induction coil 60 may be configured to heat any component of engine system 100. It is contemplated that a plurality of factors may affect the heating of surface 28. For example, the factors may include power supplied to introduce the current in induction coil 60, a frequency of the current introduced in induction coil 60, gaps between portions of induction coil 60 and portions of surface 28, and the time period during which the current is introduced in induction coil 60.

It is contemplated that the process of applying the coating solution to the surface of substrate 50 and the process of heating substrate 50 may be repeated until thickness 54 of coating 52 is at a desired value. For example, after substrate 50 is heated, substrate 50 may be subjected to an inspection. The inspection may include measuring thickness 54 to determine if thickness 54 is at a desired value. The inspection may also include measuring thickness 54 at different location on the surface of substrate 50 to determine if thickness 54 is uniform. The inspection may include other measurements to determine if coating 52 is desirable. The inspection may further include automated, manual, or semi-automated inspection. Surface 28 may be subjected to several sequential dippings into the coating solution, or several sequential applications of the coating solution using the liquid delivery device, with heating after each coating application to produce coating 52 of a desired thickness 54.

It is contemplated that the process of applying the coating solution (e.g., dipping surface 28 into the coating solution, or with the liquid delivery device) may be automated, manual, or semi-automated. Similarly, it is contemplated that the process of heating of substrate 50 may be automated, manual, or semi-automated. For example, an electronic control unit (not shown) may be connected to the liquid delivery device and induction coil 60. The electronic control unit may be configured to control the amount and the rate of the coating solution applied to the surface of substrate 50, and the heating time and temperature of substrate 50. The electronic control unit may also be configured to assist in the inspection of coating 52 on the surface of substrate 50.

Although the description above illustrates a coating on a surface of turbocharger 22, coating 52 can be applied to any ferrous substrate where corrosion resistance and/or wear resistance is desired. For example, coating 52 may be applied on a ferrous substrate of an exhaust manifold of an engine system or a gas turbine engine system component. The term corrosion is used in a broad sense in this disclosure. For instance, any interaction between the substrate and its environment that results in a degradation of the physical, mechanical, or aesthetic properties of the substrate is corrosion of the substrate.

INDUSTRIAL APPLICABILITY

The disclosed devices and methods for wear and corrosion resistance coating of a surface may be employed to improve the wear and corrosion resistance of the surface of any components in engine system 100. For example, various exemplary embodiments disclosed herein may be used to improve the wear and corrosion resistance of surfaces within turbocharger 22.

A housing of turbocharger 22 of engine system 100 may be removed from the engine system. The housing may include surface 28. Surface 28 may be cleaned to remove dirt and organic residues that may be adhered to surface 28. For example, surface 28 may be doused with acetone and may be scrubbed with a mechanical scrubber to clean loose dirt and organic debris off surface 28. Surface 28 may then be cleaned using abrasive blasting to remove rust and remnants of a prior coating that may be present on surface 28. A stream of glass beads emanating from a nozzle of a wand may be run over surface 28 for about a minute. Surface 28 may then be cleaned in water and dried. A coating solution of about 10 gms of potassium permanganate may be mixed with about 2 mls of aluminum dihydrogen phosphate and about 150 mls of water. The coating solution may then be applied to the cleaned surface 28. For example, surface 28 may be dipped into the coating solution for a few seconds. Alternatively, a liquid delivery device may be used to deliver the coating solution to surface 28. The liquid delivery device may include one or more of a mister, a sprayer, a dispenser, etc.

The coated surface 28 may then be placed adjacent induction coil 60, such that the coated surface 28 may be heated. A plurality of factors may affect the heating of surface 28. For example, the factors may include power supplied to introduce the current in induction coil 60, a frequency of the current introduced in induction coil 60, gaps between portions of induction coil 60 and portions of surface 28, and the time period during which the current is introduced in induction coil 60. Current may be introduced into induction coil 60. A power between the range of about 3 kilowatts to about 15 kilowatts may be supplied to introduce current in induction coil 60. The current introduced in induction coil 60 may have a frequency between about 4.5 Hz to about 16 Hz. An electromagnetic field may be created by the current flowing through induction coil 60. Surface 28 may then be heated to a temperature of about 600° C. Surface 28 may be placed adjacent induction coil 60 for less than about 1 minute. It is contemplated that surface 28 may be heated generally at a low power and a low frequency.

Induction coil 60 may have a coil configuration corresponding to the configuration of surface 28. Surface 28 may include upper portion 62 and lower portion 64, the portions may be of different thicknesses. For example, lower portion 64 may be of greater thickness than upper portion 62. Gap 66 may exist between upper portion 62 and first portion 70 of induction coil 60. Similarly, gap 68 may exist between lower portion 64 and second portion 72 of induction coil 60. Gap 66 may be greater than gap 68. In such instances, upper portion 62 may be heated less than lower portion 64, such that melting of upper portion 62 may be prevented where upper portion 62 is thinner (e.g., of lesser thickness) than lower portion 64. Induction coil 60 may be configured such that additional gaps may exist between surface 28 and induction coil 60 where surface 28 may include more than two portions of different thicknesses. Induction coil 60 may be differently configured to heat a surface 28 having various configuration from that shown in FIG. 4.

Surface 28 may then be removed from adjacent induction coil 60 and cooled. The cooled surface 28 may again be dipped in the coating solution and heated additional times (e.g., two more times) to get a mixed iron and manganese oxide coating 52 having thickness 54 of approximately between 5 and 10 microns. The coating may include a mixture of $FeMnO_4$, $FeMnO_2$, $Fe_2MnO_4$, and $MnO_2$. The $Fe_xMn_yO_z$ ($x \approx 0$ to 2, $y \approx 1$ to 4, $z \approx 2$ to 8) coating on surface 28 may provide sufficient corrosion and wear resistance to enable turbocharger 22 to be used in a corrosive environment. The dipping and heating coating process to apply the coating on surface 28 may also enable easy reapplication of the coating to turbocharger 22 where a prior coating has worn off. In addition, heating with the use of induction coil 60 may require less time than heating with an oven. For example, heating with an oven may require placing a component of engine system 100 into the oven where the surface of the component may not be removable. In such instances, the heating of the component may lead to distortion to a portion of the component where the portion of the component may be made of a material that is unable to withstand the heating temperature inside the oven. In such instances, the use of induction coil 60 may reduce and/or eliminate distortion because induction coil 60 may be configured with portions to heat corresponding portions of the component.

It will be apparent to those skilled in the art that various modifications and variations can be made to the disclosed methods for wear and corrosion resistance coating of a component and components made with a coating process. Other embodiments will be apparent to those skilled in the art from consideration of the specification and practice of the disclosed methods. It is intended that the specification and examples be considered as exemplary only, with a true scope being indicated by the following claims and their equivalents.

What is claimed is:

1. A method of forming a conversion coating on a surface of a ferrous metal component, comprising:

applying a coating composition including a solution of a permanganate, an acidic metal phosphate, and water to the surface of the ferrous metal component;

relatively positioning an induction coil proximate the surface; and induction heating the surface with the induction coil to form the conversion coating thereon, the conversion coating being a mixed oxide of iron and manganese.

2. The method of claim 1, wherein the acidic metal phosphate is aluminum dihydrogen phosphate.

3. The method of claim 1, wherein applying the coating composition includes dipping the component in the coating composition.

4. The method of claim 1, wherein applying the coating composition includes delivering the coating composition to the surface using a liquid delivery device.

5. The method of claim 1, wherein induction heating the surface includes heating the surface to form the coating having a substantially uniform thickness across the surface.

6. The method of claim 1, wherein applying the coating composition includes forming $MnO_4$ on the surface, and induction heating the surface includes heating the surface until the $MnO_4$ on the surface transforms to $MnO_2$.

7. The method of claim 1, further including reapplying the coating composition to the surface and heating the component to produce a desired thickness of the coating on the surface.

8. The method of claim 1, wherein relatively positioning the induction coil includes positioning the induction coil such that a gap exists between the surface and the induction coil.

9. The method of claim 1, wherein induction heating the surface includes forming the conversion coating of at least one of $FeMnO_2$, $FeMnO_4$, and $Fe_2MnO_4$ on the surface.

10. The method of claim 1, wherein applying the coating composition includes applying the coating composition having a concentration of about 4 gms to about 12 gms of potassium permanganate to about 1 ml to about 5 ml of aluminum dihydrogen phosphate in about 150 ml of water.

11. The method of claim 1, wherein the surface is part of a turbocharger.

12. A method of conversion coating a surface of a ferrous metal component, comprising:

applying a coating composition including a solution of a permanganate and an acidic metal phosphate in water to the surface; and induction heating the surface to chemically convert a layer of the surface to a conversion coating of a mixed oxide of iron and manganese.

13. The method of claim 12, wherein applying the coating composition includes applying a composition having a concentration of about 4 gms to about 12gms of potassium permanganate to about 1 ml to about 5 ml of aluminum dihydrogen phosphate in about 150 ml of water.

14. The method of claim 12, wherein applying the coating composition includes applying the coating composition to the surface of a turbocharger.

15. The method of claim 14, wherein chemically converting the layer includes forming a conformal conversion coating on the surface.

16. A method of conversion coating a component, comprising:

preparing a surface of a ferrous metal component for chemical conversion;

applying a coating composition on the surface, the coating composition including a solution of a permanganate and an acidic metal phosphate in water; and induction heating the surface using an induction coil to chemically react the coating composition with the surface and convert a layer of the surface to a mixed oxide of iron and manganese.

17. The method of claim 16, wherein applying the coating composition includes applying the coating composition having a concentration of about 4 gms to about 12 gms of potassium permanganate to about 1 ml to about 5 ml of aluminum dihydrogen phosphate in about 150 ml of water.

18. The method of claim 16, wherein chemically reacting the coating composition with the surface includes forming at least one of $FeMnO_2$, $FeMnO_4$, and $Fe_2MnO_4$ on the surface.

* * * * *

UNITED STATES PATENT AND TRADEMARK OFFICE

CERTIFICATE OF CORRECTION

PATENT NO. : 8,137,761 B2
APPLICATION NO. : 12/230320
DATED : March 20, 2012
INVENTOR(S) : Gerke et al.

It is certified that error appears in the above-identified patent and that said Letters Patent is hereby corrected as shown below:

IN THE CLAIMS:

Column 8, line 67, in Claim 13, delete "12gms" and insert -- 12 gms --.

Signed and Sealed this
Eleventh Day of August, 2015

Michelle K. Lee

Michelle K. Lee
*Director of the United States Patent and Trademark Office*